US010501985B2

(12) United States Patent
Chen et al.

(10) Patent No.: US 10,501,985 B2
(45) Date of Patent: Dec. 10, 2019

(54) SYSTEM AND DEVICE FOR WINDOW COVERING

(71) Applicant: Nien Made Enterprise Co., Ltd., Taichung (TW)

(72) Inventors: Lin Chen, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 288 days.

(21) Appl. No.: 15/472,298

(22) Filed: Mar. 29, 2017

(65) Prior Publication Data

US 2017/0292322 A1 Oct. 12, 2017

Related U.S. Application Data

(60) Provisional application No. 62/318,771, filed on Apr. 6, 2016.

(51) Int. Cl.
*E06B 9/322* (2006.01)
*E06B 9/307* (2006.01)
(Continued)

(52) U.S. Cl.
CPC ..... *E06B 9/322* (2013.01); *B65H 75/4434* (2013.01); *B65H 75/4471* (2013.01);
(Continued)

(58) Field of Classification Search
CPC . E06B 9/222; E06B 9/327; E06B 9/34; E06B 9/3222; E06B 9/322; E06B 9/307;
(Continued)

(56) References Cited

U.S. PATENT DOCUMENTS 2,410,549 A * 11/1946 Olson ..... E06B 9/305 160/168.1 R
3,194,343 A * 7/1965 Sindlinger ..... F03G 1/00 185/10
(Continued)

FOREIGN PATENT DOCUMENTS

AU 782302 B2 7/2005
AU 2012370499 A1 9/2014
(Continued)

*Primary Examiner* — Phi D A
(74) *Attorney, Agent, or Firm* — Muncy, Geissler, Olds & Lowe, P.C.

(57) ABSTRACT

A window covering system comprises a headrail, a bottom rail, a covering material, a control unit, and a first rotating unit, wherein the first rotating unit is configured to be driven to rotate in a first direction when the bottom rail descends to expand the covering material; and a locking device coiled to the first rotating unit, wherein the locking device provides a restriction force to the first rotating unit to restrict the first rotating unit from rotating in the first direction, as well as to restrict the bottom rail from descending; and an actuating device configured to operate with the control unit simultaneously; when the control unit drives the actuating device to push the locking device in order to reduce the restriction force provided by the locking device to the first rotating unit, the bottom rail descends to drive the first rotating unit to rotate in the first direction.

17 Claims, 7 Drawing Sheets

(51) Int. Cl.
*B65H 75/44* (2006.01)
*B65H 75/48* (2006.01)

(52) U.S. Cl.
CPC ..... *B65H 75/4492* (2013.01); *B65H 75/486* (2013.01); *E06B 9/307* (2013.01)

(58) Field of Classification Search
CPC ..... B65H 75/4434; B65H 75/4492; B65H 75/786
See application file for complete search history.

(56) References Cited

U.S. PATENT DOCUMENTS

| | | | | |
|---|---|---|---|---|
| 4,681,279 | A | 7/1987 | Nakamura | |
| 5,123,472 | A | 6/1992 | Nagashima et al. | |
| 6,129,131 | A | 10/2000 | Colson | |
| 6,155,328 | A | 12/2000 | Welfonder | |
| 6,330,899 | B1 * | 12/2001 | Ciuca | E06B 9/32 160/170 |
| 6,332,491 | B1 | 12/2001 | Rossini | |
| 6,715,528 | B2 | 4/2004 | Rossini | |
| 6,761,203 | B1 * | 7/2004 | Huang | E06B 9/322 160/170 |
| 6,823,925 | B2 * | 11/2004 | Militello | E06B 9/262 160/170 |
| 6,948,544 | B2 | 9/2005 | Nien | |
| 6,955,207 | B2 | 10/2005 | Minder | |
| 7,025,107 | B2 * | 4/2006 | Ciuca | E06B 9/303 160/170 |
| 7,198,089 | B2 | 4/2007 | Hsu | |
| 7,341,091 | B2 | 3/2008 | Nien | |
| 7,406,995 | B2 | 8/2008 | Huang | |
| 7,578,334 | B2 | 8/2009 | Smith et al. | |
| 7,717,154 | B2 | 5/2010 | Cheng | |
| 8,230,896 | B2 | 7/2012 | Anderson | |
| 8,267,145 | B2 | 9/2012 | Fraser | |
| 8,899,298 | B2 * | 12/2014 | Hsueh Cheng | E06B 9/80 160/170 |
| 9,062,492 | B2 | 6/2015 | Yu | |
| 9,127,500 | B2 | 9/2015 | Huang | |
| 9,272,875 | B2 * | 3/2016 | Lin | B65H 57/00 |
| 9,284,774 | B2 | 3/2016 | Yu et al. | |
| 9,435,154 | B2 * | 9/2016 | Chen | E06B 9/34 |
| 2004/0108080 | A1 | 6/2004 | Nien | |
| 2006/0278348 | A1 * | 12/2006 | Huang | E06B 9/322 160/170 |
| 2007/0227677 | A1 * | 10/2007 | Yu | E06B 9/322 160/170 |
| 2009/0078380 | A1 | 3/2009 | Cheng | |
| 2009/0120592 | A1 * | 5/2009 | Lesperance | E06B 9/322 160/84.02 |
| 2010/0206492 | A1 * | 8/2010 | Shevick | E06B 9/30 160/170 |
| 2010/0258253 | A1 | 10/2010 | Cheng | |
| 2011/0290429 | A1 | 12/2011 | Cheng | |
| 2012/0125543 | A1 | 5/2012 | Chambers | |
| 2013/0037225 | A1 | 2/2013 | Huang | |
| 2013/0087415 | A1 | 4/2013 | Hsieh | |
| 2013/0220561 | A1 | 8/2013 | Fu-Lai et al. | |
| 2013/0233499 | A1 | 9/2013 | Wu | |
| 2014/0083631 | A1 | 3/2014 | Huang | |
| 2014/0131502 | A1 | 5/2014 | Zhu | |
| 2014/0291431 | A1 | 10/2014 | Huang | |
| 2015/0028144 | A1 | 1/2015 | Defenbaugh et al. | |
| 2015/0059992 | A1 | 3/2015 | Liu | |
| 2015/0136336 | A1 * | 5/2015 | Huang | E06B 9/322 160/170 |
| 2015/0211296 | A1 | 7/2015 | Zhang et al. | |
| 2015/0354275 | A1 | 12/2015 | Huang et al. | |
| 2015/0368968 | A1 | 12/2015 | Smith | |
| 2017/0145743 | A1 * | 5/2017 | Lei | B65H 75/26 |
| 2017/0298688 | A1 * | 10/2017 | Chen | E06B 9/262 |

FOREIGN PATENT DOCUMENTS

| | | | |
|---|---|---|---|
| CA | 2425959 | A1 | 10/2004 |
| CA | 2805798 | A1 | 8/2014 |
| CN | 101021139 | B | 7/2010 |
| CN | 204552565 | U | 8/2015 |
| DE | 202007002787 | U1 | 7/2008 |
| JP | H04250287 | A | 9/1992 |
| JP | 1993018168 | A | 1/1993 |
| JP | 2000145328 | A | 5/2000 |
| JP | 2000220369 | A | 8/2000 |
| JP | 3261106 | B2 | 2/2002 |
| JP | 2002106268 | A | 4/2002 |
| JP | 3378813 | B2 | 2/2003 |
| JP | 3442670 | B2 | 9/2003 |
| JP | 3485164 | B2 | 1/2004 |
| JP | 2008013950 | A | 1/2008 |
| JP | 4074420 | B2 | 4/2008 |
| JP | 2013072183 | A | 4/2013 |
| JP | 2013072224 | A | 4/2013 |
| JP | 2015508466 | A | 3/2015 |
| JP | 2015161147 | A | 9/2015 |
| JP | 2015180810 | A | 10/2015 |
| TW | I246415 | B | 1/2006 |
| TW | M305849 | U | 2/2007 |
| TW | I463961 | B | 12/2014 |
| WO | 2010125951 | A1 | 11/2010 |
| WO | 2016009881 | A1 | 1/2016 |

* cited by examiner

SYSTEM AND DEVICE FOR WINDOW COVERING

CROSS REFERENCE TO RELATED APPLICATION

This application claims priority to U.S. Provisional Patent Application No. 62/318,771, filed Apr. 6, 2016, the contents of which are incorporated by reference herein.

FIELD OF THE DISCLOSURE

The present disclosure relates generally to a window covering system. More specifically, the present disclosure relates to a window covering system that can be unlocked easily.

BACKGROUND OF THE DISCLOSURE

Traditionally, a window covering system includes a headrail, a covering material, a bottom rail and a driving device. The covering material is positioned between the headrail and the bottom rail. The driving device is positioned in the headrail, wherein the driving device includes a spring box and a lifting cord module. The lifting cord module includes a winding spool which can be driven to rotate by the spring box or the bottom rail and a lifting cord which is wound upon the winding spool and connected to the headrail and the bottom rail, wherein the lifting cord can pass through the covering material. Alternatively, the covering material can be disposed in a space defined by the lifting cord. When the lifting cord is driven by the spring box or the bottom rail, the lifting cord can be collected by or released from the winding spool, such that the bottom rail moves toward or away from the headrail in order to control the collection or expansion of the covering material.

When the weight of the covering material and the bottom rail with the force provided by the spring box are balanced by the friction force of the whole window covering system, the bottom rail can stop at any position to retain the level of light blockage of the covering material. However, the friction force of the whole window covering system is difficult to be controlled effectively comparing to the weight of the covering material and the bottom rail. Especially, the force provided by the spring box is generated by the elasticity of a spiral spring within the spring box, wherein the spiral spring has a problem of potential elastic fatigue. In addition, the closer the bottom rail ascends to the headrail, the more covering material accumulates on the bottom rail, and hence the heavier the overall weight of the bottom rail and the covering material. Therefore, it is likely that the bottom rail would more or less descend for a distance from a desired position. In such case, it is inconvenient and annoying to anyone operating the window covering system. In respect of the above problems, a locking device should be provide to fix the bottom rail at any position, thereby the bottom rail can remain stationary regardless of gravity. However, the locking device must be unlocked to descend the bottom rail and expand the covering material. Moreover, an operable height of a window covering for different users may be different, thus a convenient unlocking method should be provided to coordinate with the locking device to ease the operation of the window covering system.

BRIEF SUMMARY OF THE DISCLOSURE

In view of the foregoing subject, a general objective of the present disclosure is to provide a window covering system which can lock and unlock at any position.

A window covering system comprises a headrail, a bottom rail, a covering material, and a control unit, wherein the covering material is positioned between the headrail and the bottom rail, and the control unit is positioned outside of the headrail; and a first rotating unit positioned within the headrail, wherein the first rotating unit is configured to be driven to rotate in a first direction when the bottom rail descends to expand the covering material; and a locking device coiled to the first rotating unit, wherein the locking device comprises a fixed end and a free end, and the fixed end is fixed relative to the headrail, and wherein the locking device is configured to provide a restriction force to the first rotating unit in order to restrict the first rotating unit from rotating in the first direction, as well as to restrict the bottom rail from descending; and an actuating device comprising a pushing part, which is positioned corresponding to the fixed end and configured to operate with the control unit simultaneously, wherein the control unit is configured to drive the pushing part of the actuating device to push the free end of the locking device to move in order to remove the rotation restriction to the first rotating unit by reducing the restriction force provided by the locking device to the first rotating unit; when the rotation restriction to the first rotating unit is removed, the bottom rail descends by gravity to drive the first rotating unit to rotate in the first direction.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, wherein.

In accordance with common practice, the various described features are not drawn to scale and are drawn to emphasize features relevant to the present disclosure. Like reference characters denote like elements throughout the figures and text.

DETAILED DESCRIPTION OF THE DISCLOSURE

Figure 1:
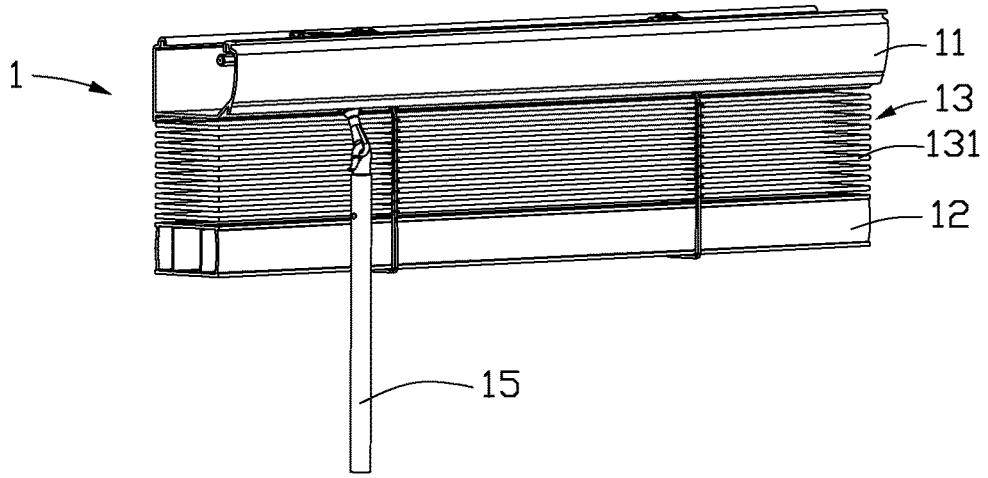
FIG. 1 is a schematic illustration of a window covering system in a collected state according to one embodiment of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, layer or section. Thus, a first element, component, region, part or section discussed below could be termed a second element, component, region, layer or section without departing from the teachings of the present disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present disclosure in conjunction with the accompanying drawings in FIG. 1 to 13. Reference will be made to the drawing figures to describe the present disclosure in detail, wherein depicted elements are not necessarily shown to scale and wherein like or similar elements are designated by same or similar reference numeral through the several views and same or similar terminology.

Figure 2:
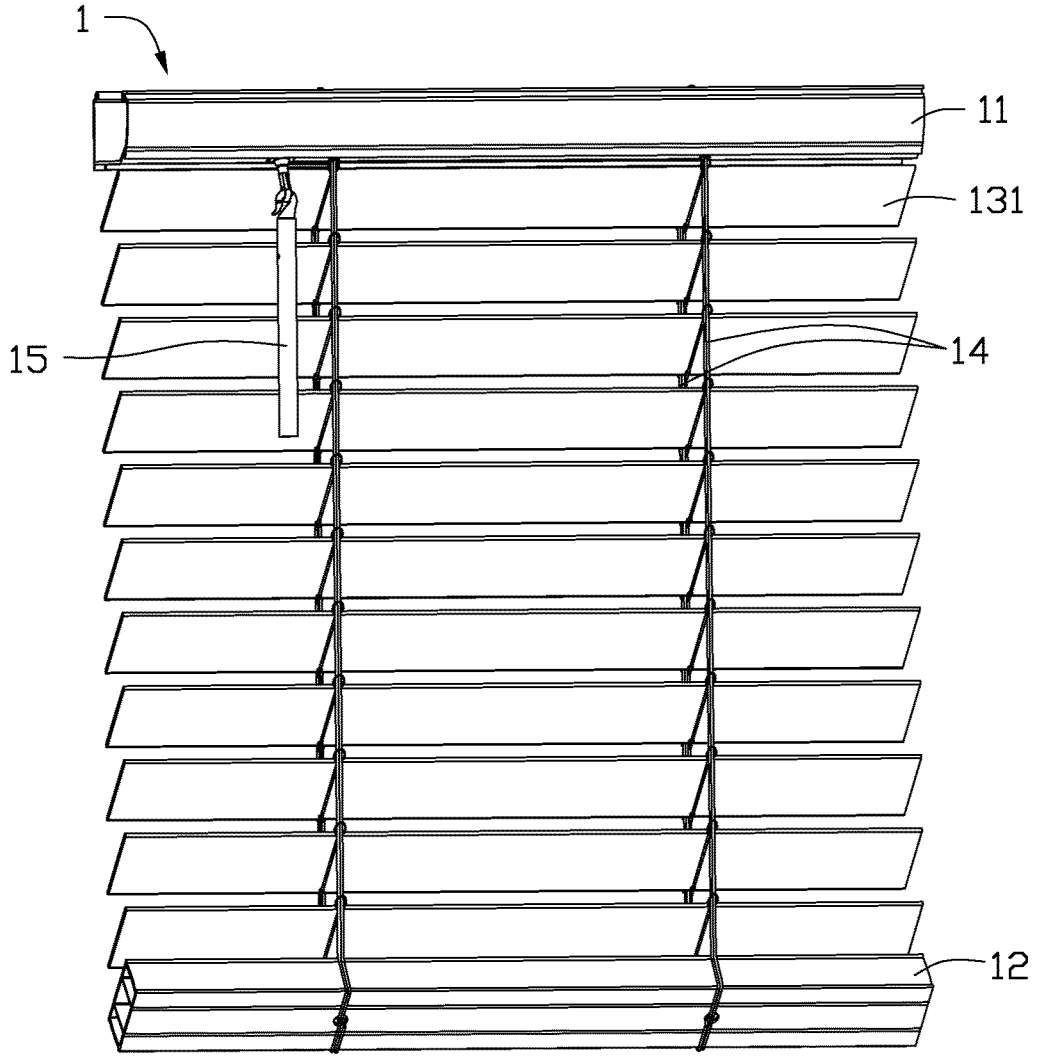
FIG. 2 is a schematic illustration of the window covering system in FIG. 1 in an expanded state.
Figure 3:
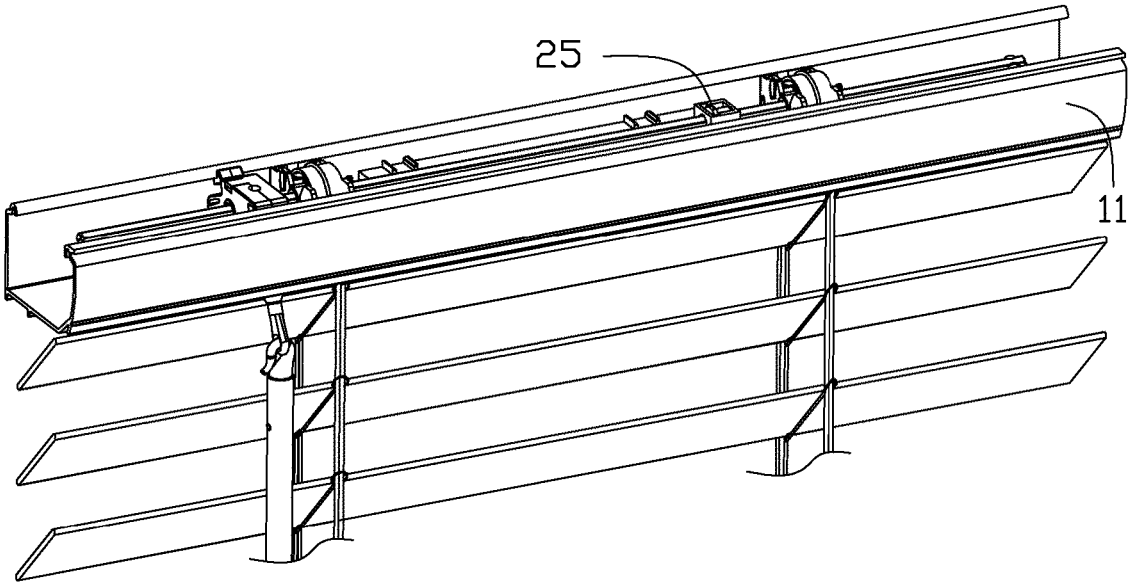
FIG. 3 is a partial perspective view of the window covering system in FIG. 2.
Figure 4:
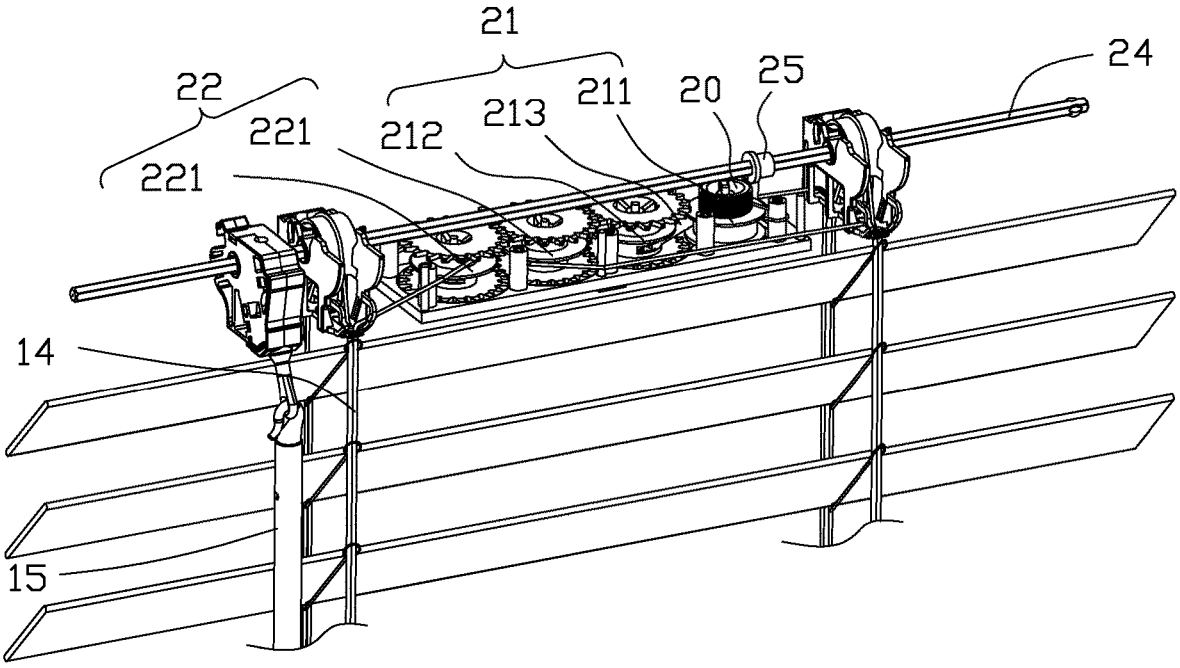
FIG. 4 is a perspective view of the window covering system in FIG. 3, wherein a headrail of the window covering system is removed.
Figure 5:
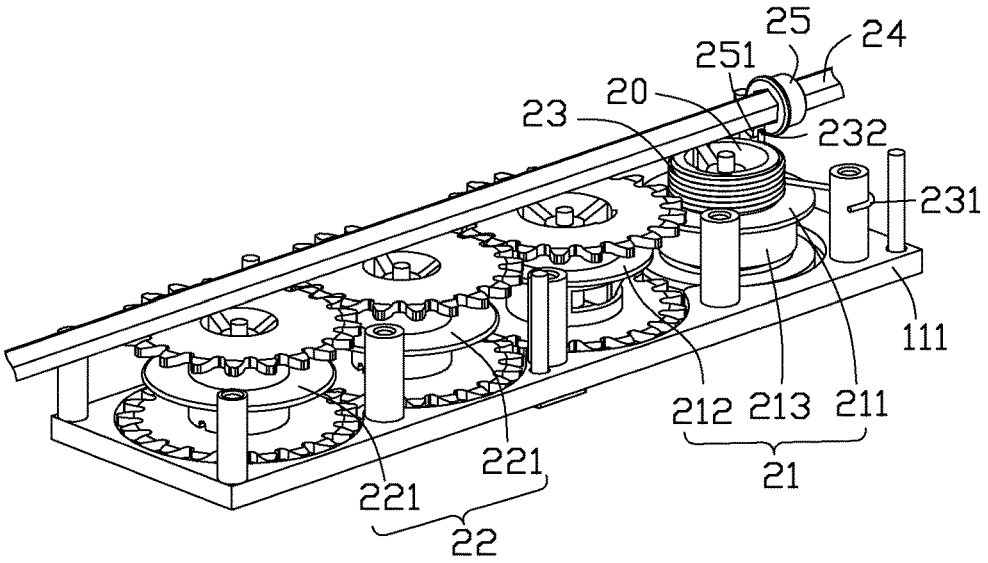
FIG. 5 is a partial perspective view of the window covering system in FIG. 4.
Figure 6:
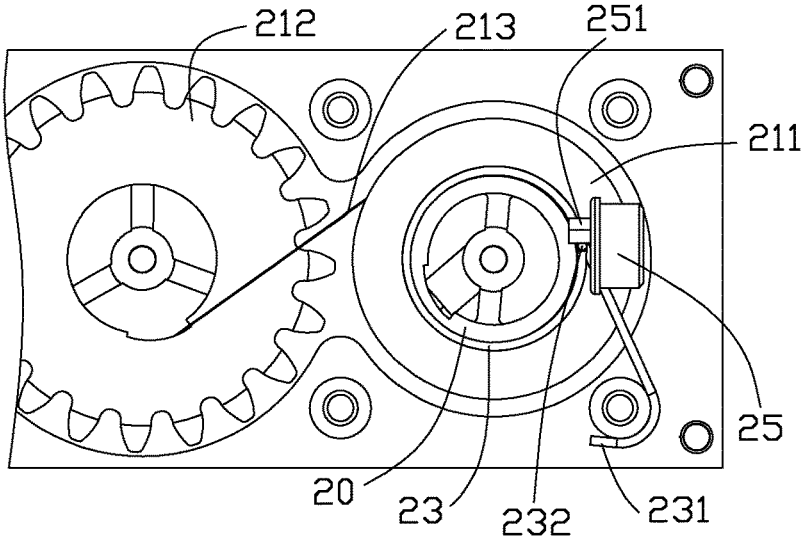
FIG. 6 is a top view of the window covering system in FIG. 5.
Figure 7:
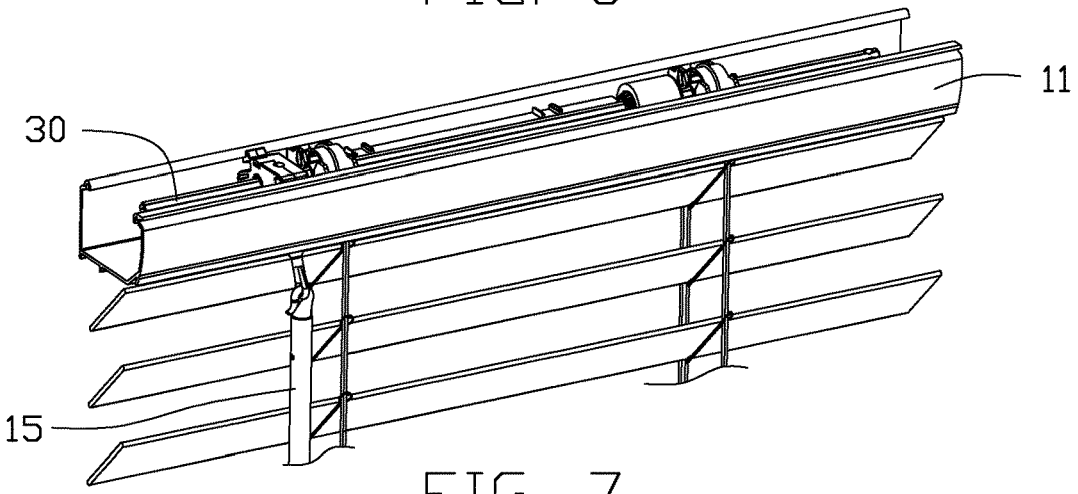
FIG. 7 is a partial perspective view of a window covering system in the expanded state according another embodiment of the present disclosure.

Referring FIG. 1 and FIG. 2, a window covering system 1 comprises a shell, a weight member, a covering material, a lifting cord, and a control unit according to one embodiment of the present disclosure, wherein the window covering system 1 can be a blind. The shell can be a headrail 11 or a modularized base 111 modularized for easy installation (as shown in FIG. 4 and FIG. 5). The weight member can be a bottom rail 12 positioned corresponding to the headrail 11, and the weight of the bottom rail 12 can provide a downward force to the bottom rail 12. The covering material 13 is positioned between the headrail 11 and the bottom rail 12, wherein the covering material 13 is formed by a plurality of slats 131. The lifting cord 14 is provided at the front and rear of the slats 131, or the lifting cord 14 can also pass through the slats 131 (not shown). One end of the lifting cord 14 is connected to the headrail 11, and the other end of the lifting cord 14 is connected to the bottom rail 12. The control unit can be a stick 15 positioned outside of the headrail 11, but the type of the control unit is not limited thereto, such that other manual or electrical type can be employed as well. As shown in FIG. 1 and FIG. 2, the covering material 13 can be collected or expanded when the length of the lifting cord 14 between the headrail 11 and the bottom rail 12 is adjusted.

Referring to FIG. 3 to FIG. 6, the window covering system 1 according to one embodiment of the present disclosure is provided. There are a first rotating unit 20, a second rotating unit, a third rotating unit, a driving device 21, a winding device 22, a locking device, a rod 24, and an actuating device 25 positioned in the headrail 11. The first rotating unit 20 is configured to operate with the driving device 21 simultaneously, wherein the driving device 21 comprises a storing wheel 211, a driving wheel 212, and an elastic unit. In one embodiment of the present disclosure, the second rotating unit can be the storing wheel 211, and the elastic unit can be a spiral spring 213 which is connected to the storing wheel 211 at one end and to the driving wheel 212 at the other end, such that the spiral spring 213 can wind upon the storing wheel 211 or be released from the storing wheel 211 to wind upon the driving wheel 212. The winding device 22 and the driving device 21 are adjacent to each other and configured to operate simultaneously, wherein the winding device 22 comprises at least one winding spool 221. In one embodiment of the present disclosure, the third rotating unit can be the winding spool 221 which is engaged to the driving wheel 212 of the driving device 21 by toothed engagement, and the winding spool 221 and the driving wheel 212 are operated simultaneously with each other. The winding spool 221 is connected to the lifting cord 14 for collecting or releasing the lifting cord 14 in order to adjust the length of the lifting cord 14, thereby moving the bottom rail 12 toward or away from the headrail 11 (as shown in FIG. 1 and FIG. 2). Additional winding spool 221 can be provided in respect of the number of lifting cord 14, wherein multiple winding spools 221 are engaged by toothed engagement to rotate simultaneously.

The locking device can be a restriction spring 23 which is coiled to the first rotating unit 20, wherein the restriction spring 23 comprises a fixed end 231 and a free end 232, and the fixed end 231 is connected to the base 111 and fixed relative to the headrail 11, and the restriction spring 23 can provide a restriction force to the first rotating unit 20. The rod 24 is positioned along the long axis of the headrail 11 and connected to the stick 15, thus the rod 24 can be driven by the stick 15 to rotate. The actuating device 25 is sleeved and fixed to the rod 24 along an axial direction of the rod 24 thus can rotate in the same direction with the rod 24 simultaneously, and the actuating device 25 comprises a pushing part 251 which is positioned corresponding to the free end 232 of the restriction spring 23.

In one embodiment of the present disclosure, the rotating unit 20, the storing wheel 211, the driving wheel 212, and the winding spool 221 are pivotally connected within the headrail 11 and configured to rotate relative to the headrail 11. In another embodiment, the rotating unit 20, the storing wheel 211, the driving wheel 212, and the winding spool 221 are pivotally connected to the base 111 fixed to the headrail 11 as shown in FIG. 5 and configured to rotate relative to the base 111 and the headrail 11.

In one embodiment of the present disclosure, the first rotating unit 20 is coaxial to the storing wheel 211, thus can rotate in the same direction with the storing wheel 211 simultaneously. The storing wheel 211 is configured to operate with the driving wheel 212 simultaneously by the spiral spring 213 winding or unwinding in between; the driving wheel 212 of the driving device 21 is configured to operate with the winding spool 221 of the winding device 22 simultaneously by toothed engagement in between. Therefore, the first rotating unit 20, the storing wheel 211, the driving wheel 212, and the winding spool 221 can operate simultaneously with one another. When the restriction spring 23 provides the restriction force to the first rotating unit 20 in order to restrict the first rotating unit 20 from rotating in a first direction, which is the direction that the first rotating unit 20 can rotate to descend the bottom rail 12, the storing wheel 211, the driving wheel 212, and the winding spool 221 are restricted from rotating simultaneously. When the restriction force provided by the restriction spring 23 reduces till the first rotating unit 20 is able to rotate in the first direction, the rotation restriction to the storing wheel 211, the driving wheel 212, and the winding spool 221 is removed simultaneously.

When the covering material 13 is collected completely, also known as collected state, the spiral spring 213 is forwardly wound to the storing wheel 211, furthermore, a rotation force is provided to the winding spool 221 because of the weight of the bottom rail 12 acting upon the lifting cord 14 which is wound on the winding spool 221, therefore, the driving wheel 212 which can rotate simultaneously with the winding spool 221 has a rotation force as well. At this time, because of the restriction force is provided to the first rotating unit 20 by the restriction spring 23, such that restricting the first rotating unit 20 from rotating in the first direction, and the storing wheel 211, the driving wheel 212, and the winding spool 221 are restricted from rotating simultaneously, thereby restricting the bottom rail 12 from descending, thus the covering material 13 is kept collected.

When the stick 15 is operated by a force to drive the rod 24 rotating for expanding the covering material 13, the rod 24 drives the actuating device 25 to rotate, wherein the pushing part 251 of the actuating device 25 is corresponding to the free end 232 of the restriction spring 23, therefore, the pushing part 251 pushes the free end 232 as the actuating device 25 rotates. Hence, the diameter of the restriction spring 23 increases while the free end 232 is pushed to move, such that decreases the restriction force. When the restriction force provided by the restriction spring 23 reduces till the first rotating unit 20 is able to rotate in the first direction, that removes the rotation restriction to the first rotating unit 20. At the same time, the rotation restriction to storing wheel 211, the driving wheel 212, and the winding spool 221 is removed simultaneously. Therefore, the weight of the bottom rail 12 can drive the winding spool 221 to release the lifting cord 14, and the bottom rail 12 descends by gravity to expand the covering material 13. Hence, the driving wheel 212 is driven to rotate by the rotation of the winding spool 221, thus the spiral spring 213 connected to the driving wheel 212 is released from the storing wheel 211 such that reversely winding upon the driving wheel 212 to store a restoring energy. When the covering material 13 is completely expanded, also known as expanded state, the weight of the covering material 13 and the bottom rail 12, and a pulling force provided by the spiral spring 213 are balanced by the friction force of the whole window covering system 1, thereby the covering material 13 is kept expanded.

If the covering material 13 is to be collected, the bottom rail 12 can be pushed upward to ascend in order to break the balance, which causes the spiral spring 213 on the driving wheel 212 to unleash the restoring energy to wind back onto the storing wheel 211, wherein the restoring energy drives the winding spool 221 to rotate. When the driving wheel 212 rotates, the winding spool 221 of the winding device 22 is driven to rotate, thus collecting the lifting cord 14 that ascends the bottom rail 12 and collects the covering material 13. While the covering material 13 is being collected, the pushing part 251 of the actuating device 25 can push the free end 232 of the restriction spring 23, such that increasing the diameter of the restriction spring 23 and reducing the restriction force acting upon the first rotating unit 20, thereby decreasing a resistance of the first rotating unit 20 rotating in a direction opposite to the first direction. After the covering material 13 is collected, the stick 15 can be operated to drive the rod 24 to rotate, such that drives the pushing part 251 of the actuating device 25 away from the free end 232 of the restriction spring 23, therefore the restriction spring 23 can provide the restriction force to the first rotating unit 20 in order to restrict the first rotating unit 20 from rotating in the first direction, but not limited thereto.

The following embodiments that are not shown in the figures are only for further illustrating the present disclosure, but not intend to limit the scope of the present disclosure. As aforementioned, the first rotating unit 20, the driving device 21, and the winding device 22 are configured to operate simultaneously. Therefore, in one embodiment of the present disclosure, the second rotating unit is the driving wheel of the driving device, and the first rotating unit is adjacent to the driving device and configured to operate with the driving device simultaneously, thus the driving wheel, the storing wheel, and the winding device are restricted from rotating simultaneously when the first rotating unit is restricted from rotating in the first direction by the restriction force from the restriction spring.

In another embodiment of the present disclosure, the second rotating unit is the winding spool of the winding device, and the first rotating unit is adjacent to the winding device and configured to operate with the winding device simultaneously, and the third rotating unit is the driving wheel or the storing wheel of the driving device and configured to operate with the winding spool simultaneously, thus the driving device and the winding device are restricted from rotating simultaneously when the first rotating unit is restricted from rotating in the first direction by the restriction force from the restriction spring.

In another embodiment of the present disclosure, the second rotating unit is the driving wheel of the driving device, and the first rotating unit is coaxial to the driving device and configured to rotate with the driving device in the same direction simultaneously, thus the storing wheel and the winding device are restricted from rotating simultaneously when the first rotating unit and the driving wheel are restricted from rotating in the first direction by the restriction force from the restriction spring.

In another embodiment of the present disclosure, the second rotating unit is the winding spool of the winding device, and the first rotating unit is coaxial to the winding device and configured to rotate with the winding device in the same direction simultaneously, and the third rotating unit is the driving wheel or the storing wheel of the driving device and configured to operate with the winding spool simultaneously, thus the driving device and the winding device is restricted from rotating simultaneously when the first rotating unit and the winding spool are restricted from rotating in the first direction by the restriction force from the restriction spring.

Referring to FIG. 7 to FIG. 12, the window covering system 1 according to one embodiment of the present disclosure is provided. There are a rod 30, a first rotating unit 31, a first gear 32, a one-way clutch 33, a second rotating unit, a winding device 34, a second gear 35, a third rotating unit, a driving device 36, a locking device, and an actuating device 38 positioned in the headrail 11. The rod 30 is positioned along the long axis of the headrail 11 and connected to the stick 15, wherein the rod 30 can be driven by the stick 15 to rotate. The first rotating unit 31 is sleeved to the rod 30 coaxially and configured to rotate relative to the rod 30. The first gear 32 is positioned coaxially to the rotation axis of the first rotating unit 31, wherein the first gear 32 is connected to the one-way clutch 33 such that the one-way clutch 33 is positioned corresponding to the first rotating unit 31. When the first gear 32 is rotating in a first direction, which is the direction that the first gear 32 can rotate to descend the bottom rail 12, the first rotating unit 31 is configured to engage the first gear 32 via the one-way clutch 33, thereby rotating with the first gear 32 simultaneously in the same direction; when the first gear 32 is rotating in a direction opposite to the first direction, the first rotating unit 31 is configured to disengage from the first gear 32 via the one-way clutch 33, thereby the first gear 32 and the one-way clutch 33 rotates alone relative to the first rotating unit 31, and the first rotating unit 31 does not rotate relative to the headrail 11.

Figure 8:
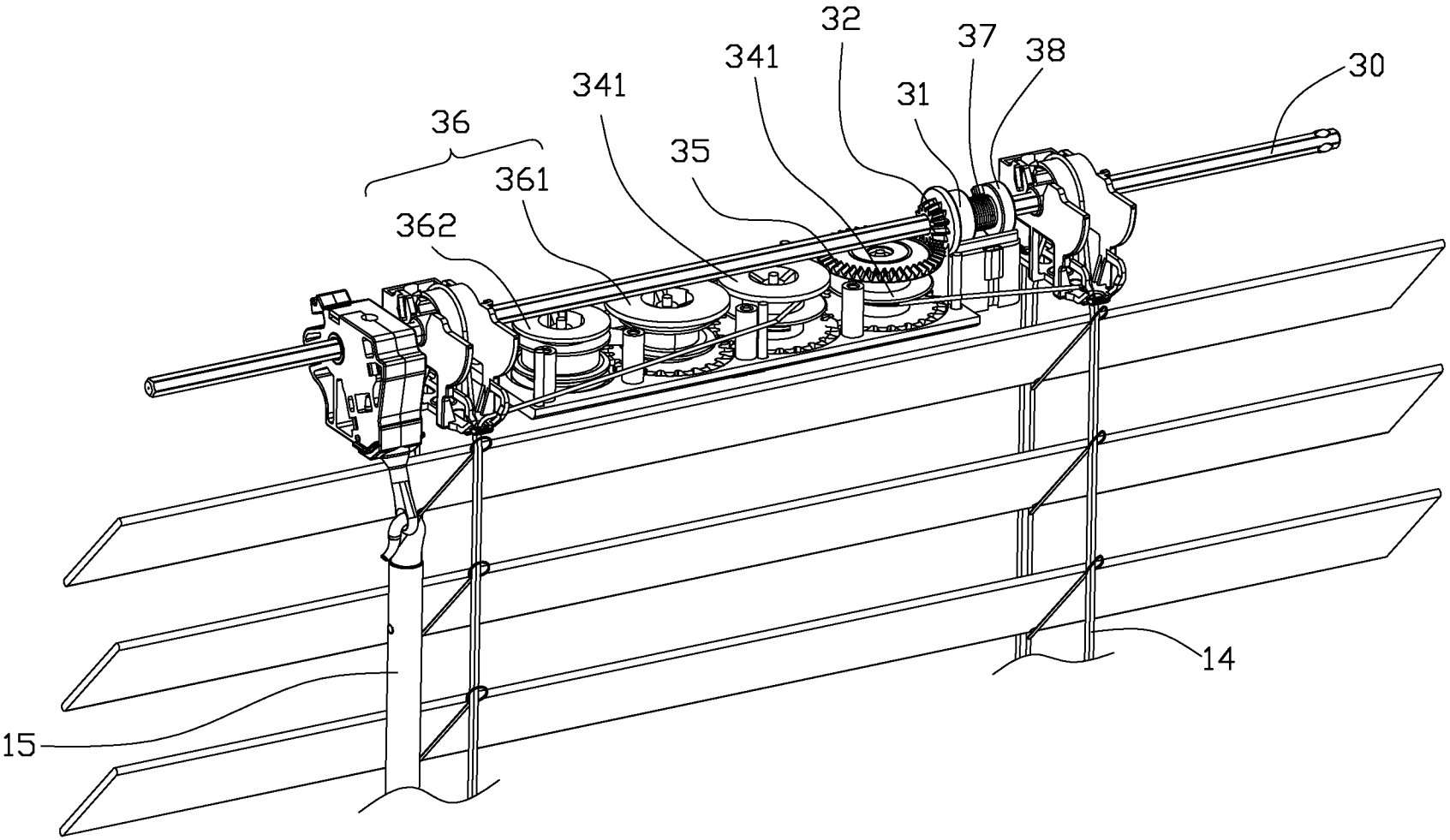
FIG. 8 is a perspective view of the window covering system in FIG. 7.
Figure 9:
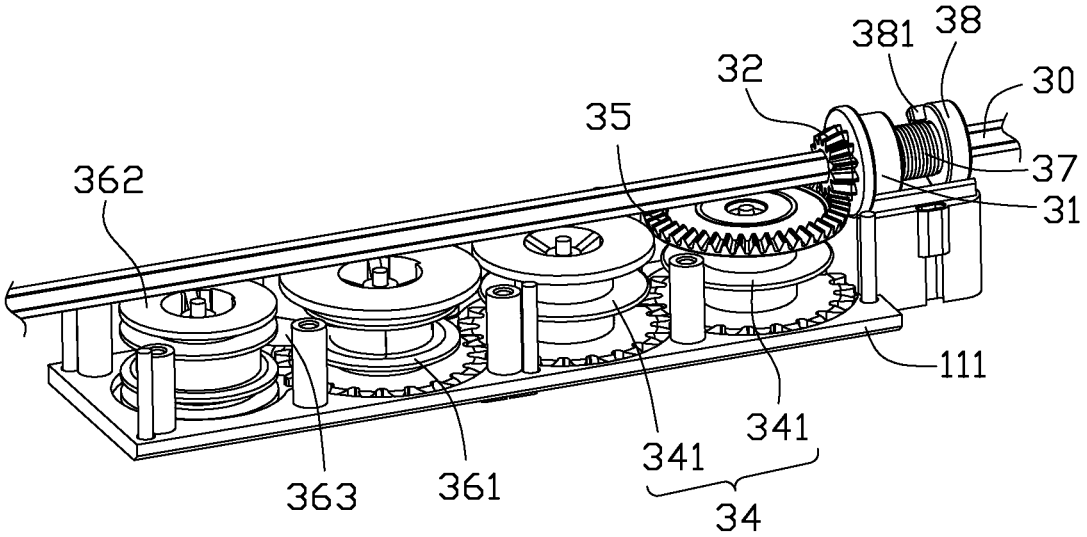
FIG. 9 is a partial perspective view of the window covering system in FIG. 8.
Figure 10:
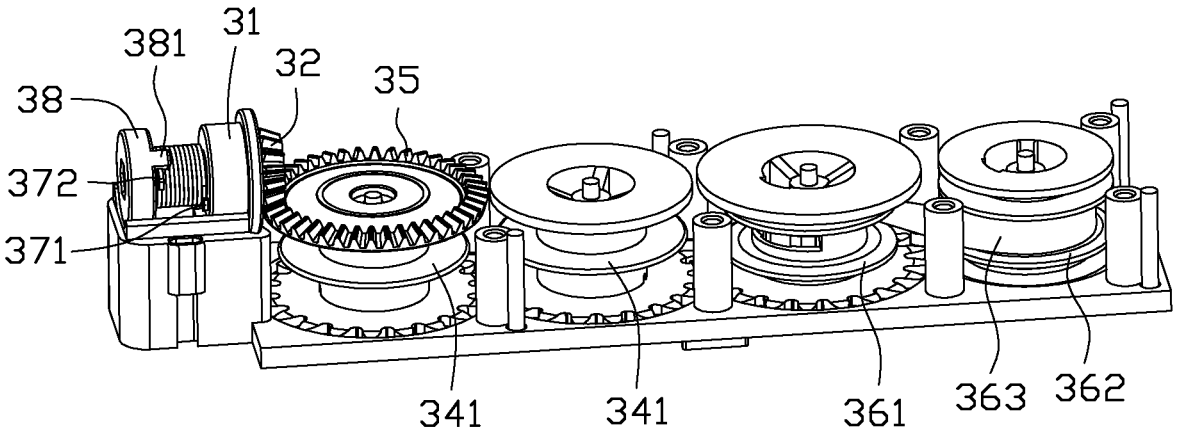
FIG. 10 is a partial perspective view of the window covering system in FIG. 7 from another angle.
Figure 11:
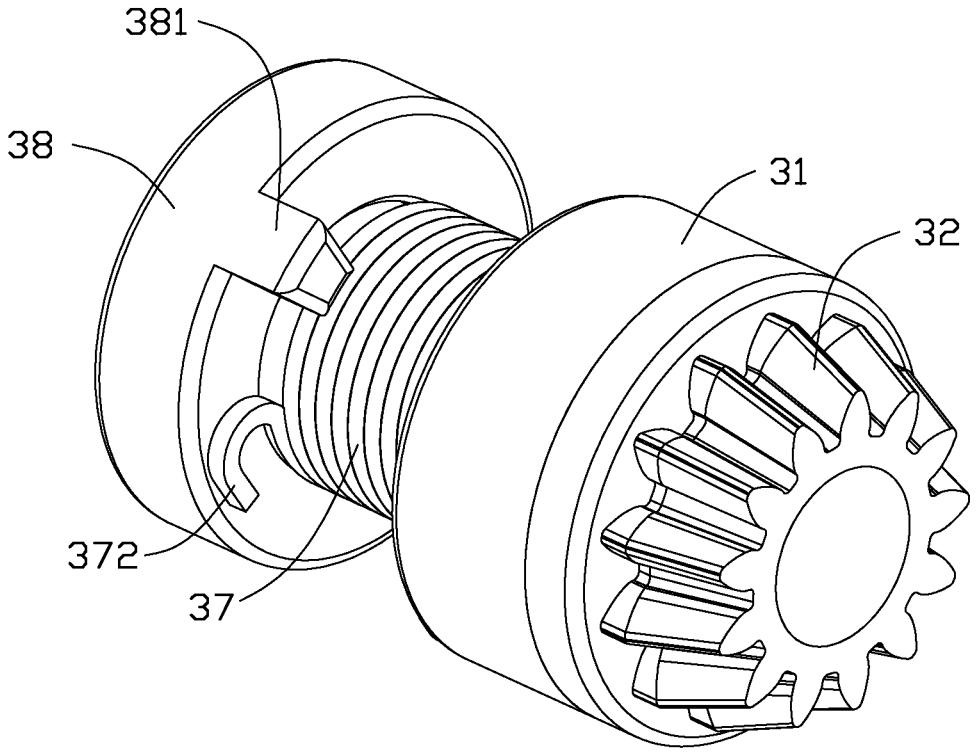
FIG. 11 is a partial perspective view of the window covering system in FIG. 10.
Figure 12:
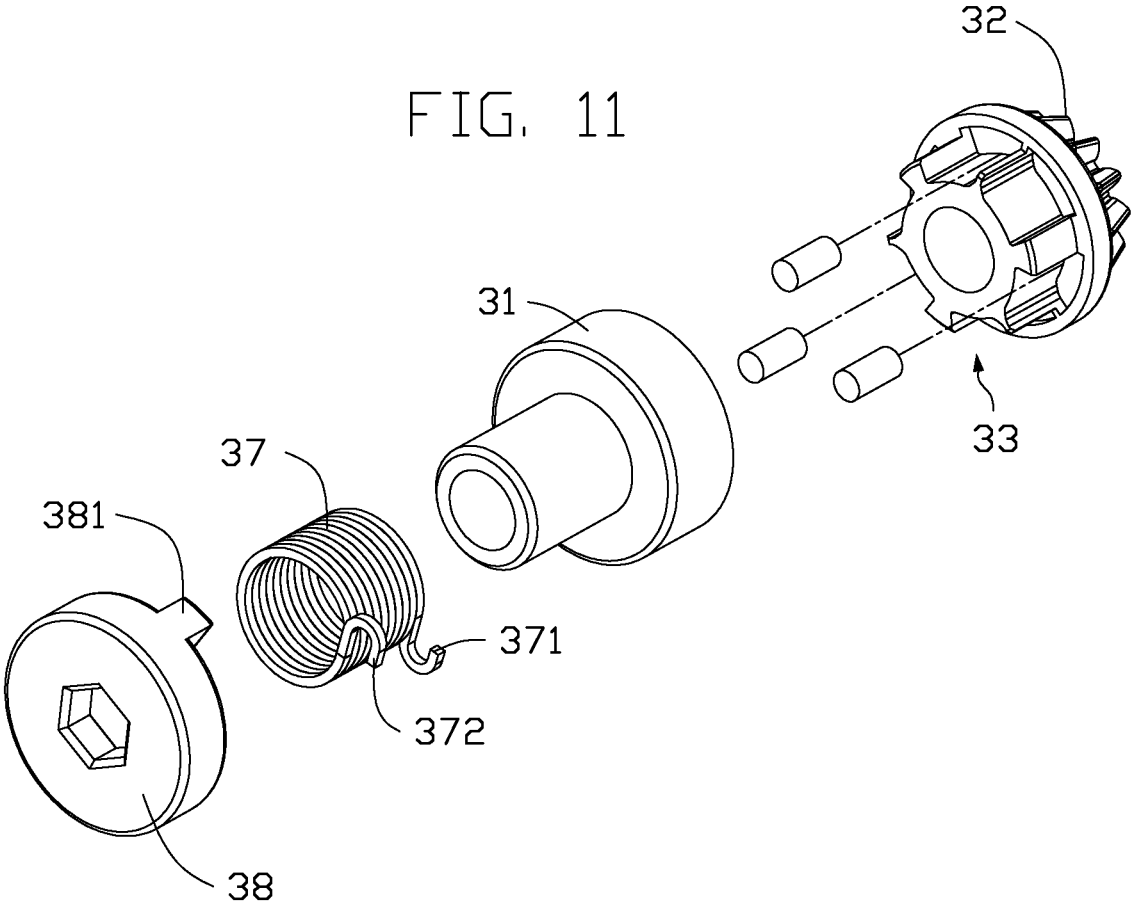
FIG. 12 is an exploded illustration of the window covering system in FIG. 11.

The winding device 34 comprises at least a winding spool 341 according to one embodiment of the present disclosure. In one embodiment of the present disclosure, the second rotating unit can be the winding spool 341 which has a rotation axis substantially perpendicular to the rotation axis of the first rotating unit 31, wherein the second gear 35 is positioned coaxially to the rotation axis of the winding spool 341, and the second gear 35 is configured to operate with the winding spool 341 simultaneously in the same direction, wherein the second gear 35 and the first gear 32 are engaged by toothed engagement, such that the first gear 32 and the second gear 35 are configured to drive each other rotating. The winding spool 341 is connected to the lifting cord 14 for collecting or releasing the lifting cord 14 in order to adjust the length of the lifting cord 14, thereby moving the bottom rail 12 toward or away from the headrail 11 (as shown in FIG. 1 and FIG. 2). Additional winding spool can be provided in respect of the number of lifting cord 14, wherein multiple winding spools are engaged by toothed engagement to rotate simultaneously (as shown in FIG. 8 and FIG. 9).

The driving device 36 is adjacent to the winding device 34 and configured to operate with the winding device 34 simultaneously, wherein the driving device 36 comprises a driving wheel 361, a storing wheel 362, and an elastic unit, wherein the third rotating unit can be the driving wheel 361, which is configured to operate with the winding spool 341 of the winding device 34 simultaneously by toothed engagement. The elastic unit can be a spiral spring 363 which is connected to the storing wheel 362 at one end and to the driving wheel 361 at the other end, such that the spiral spring 363 can wind upon the storing wheel 362 or be released from the storing wheel 362 to wind upon the driving wheel 361. Therefore, the storing wheel 362 can operate with the driving wheel 361 simultaneously by the spiral spring 363 winding or unwinding in between.

In one embodiment of the present disclosure, the winding spool 341, the driving wheel 361, and the storing wheel 362 are pivotally connected in the headrail 11 and configured to rotate relative to the headrail 11. In another embodiment, the winding spool 341, the driving wheel 361, and the storing wheel 362 are pivotally connected to the base 111 fixed to the headrail 11 as shown in FIG. 9 and configured to rotate relative to the base 111 and the headrail 11.

The locking device can be a restriction spring 37 which is coiled to the first rotating unit 31, wherein the restriction spring 37 comprises a fixed end 371 and a free end 372, and the fixed end 371 is connected to the base 111 and fixed relative to the headrail 11. The actuating device 38 is sleeved to the rod 30 coaxially thus can rotate in the same direction with the rod 30 simultaneously, and the actuating device 38 comprises a pushing part 381 which is positioned corresponding to the free end 372 of the restriction spring 37.

In one embodiment of the present disclosure, the winding device 34 and the driving device 36 are configured to operate simultaneously, wherein the driving device 34 can operate with the first rotating unit 31 simultaneously via the toothed engagement between the first gear 32 and the second gear 35 and the engagement between the one-way clutch 33 and the first gear 32. Therefore, when a restriction force is provided by the restriction spring 37 to the first rotating unit 31 in order to restrict the first rotating unit 31 from rotating in the first direction, which is the direction that the first rotating unit 31 can rotate to descend the bottom rail 12, the first gear 32, the second gear 35, the winding spool 341 of the winding device 34, and the driving device 36 are restricted from rotating simultaneously. When the restriction force provided by the restriction spring 37 reduces till the first rotating unit 31 is able to rotate in the first direction, the rotation restriction to the first gear 32, the second gear 35, the winding spool 341 of the winding device 34, and the driving device 36 is removed simultaneously.

When the covering material 13 is collected completely, also known as collected state, the spiral spring 363 is forwardly wound to the storing wheel 362, furthermore, a rotation force is provided to the winding spool 341 because of the weight of the bottom rail 12 acting upon the lifting cord 14 which is wound on the winding spool 341, therefore, the driving wheel 361 which can rotate simultaneously with the winding spool 341 has a rotation force as well. At this time, because of the restriction force is provided to the first rotating unit 31 by the restriction spring 37, such that restricting the first rotating unit 31 from rotating in the first direction, and the first gear 32, the second gear 35, the winding spool 341, and the driving device 36 are restricted from rotating simultaneously, thereby restricting the bottom rail 12 from descending, thus the covering material 13 is kept collected.

When the stick 15 is operated by a force to drive the rod 30 rotating for expanding the covering material 13, the rod 30 drives the actuating device 38 to rotate, wherein the pushing part 381 of the actuating device 38 is corresponding to the free end 372 of the restriction spring 37, therefore, the pushing part 381 pushes the free end 372 as the actuating device 38 rotates. Hence, the diameter of the restriction spring 37 increases while the free end 372 is pushed to move, such that decreases the restriction force. When the restriction force provided by the restriction spring 37 reduces till the first rotating unit 31 is able to rotate in the first direction, that removes the rotation restriction to the first rotating unit 31. At the same time, the rotation restriction to the first gear 32, the second gear 35, the winding spool 341, and the driving device 36 is removed simultaneously. Therefore, the weight of the bottom rail 12 can drive the winding spool 341 to release the lifting cord 14, and the bottom rail 12 descends by gravity to expand the covering material 13. Hence, the winding spool 341 drives the second gear 35 to rotate, thus the first gear 32 is rotated by the second gear 35 in the first direction due to the toothed engagement in between, and the first rotating unit 31 is engaged to the first gear 32 via the one-way clutch 33, such that the first gear 32 can drive the first rotating unit 31 to rotate, therefore, the first rotating unit 31 and the first gear 32 rotate in the same direction, which is the first direction, simultaneously relative to the rod 30. While the winding spool 341 is rotating, the driving wheel 361 is driven to rotate by the winding spool 341, thus the spiral spring 363 connected to the driving wheel 361 is released from the storing wheel 362 such that reversely winding upon the driving wheel 361 to store a restoring energy. When the covering material 13 is completely expanded, also known as expanded state, the weight of the covering material 13 and the bottom rail 12, and a pulling force provided by the spiral spring 363 are balanced by the friction force of the whole window covering system 1, thereby the covering material 13 is kept expanded.

If the covering material 13 is to be collected, the bottom rail 12 can be pushed upward to ascend in order to break the balance, which causes the spiral spring 363 on the driving wheel 361 to wind back onto the storing wheel 362 and to unleash the restoring energy, wherein the restoring energy drives the driving wheel 361 to rotate. When the driving wheel 361 rotates, the winding spool 341 of the winding device 22 is driven to rotate, thus collecting the lifting cord 14 that ascends the bottom rail 12 and collects the covering material 13. While the covering material 13 is being collected, the second gear 35 rotates with the winding spool 341 in the same direction simultaneously and drives the first gear 32 to rotate in a direction opposite to the first direction, and the first rotating unit 31 is disengaged from the first gear 32 via the one-way clutch 33, such that the first gear 32 and the one-way clutch 33 rotate solely relative to the first rotating unit 31, therefore, the restriction force provided by the restriction spring 37 to the first rotating unit 31 does not restrict the winding spool 341 from rotating, thereby the covering material 13 can be collected.

The following embodiments that are not shown in the figures are only for further illustrating the present disclosure, but not intend to limit the scope of the present disclosure. As aforementioned, the first rotating unit 31, the first gear 32, the second gear 35, the driving device 36, and the winding device 34 are configured to operate simultaneously. Therefore, in one embodiment of the present disclosure, the second rotating unit is the driving wheel of the driving device, and the second gear is positioned coaxially to the rotation axis of the driving wheel and configured to operate simultaneously with the driving wheel, wherein the second gear is engaged to the first gear by toothed engagement, and the third rotating unit is the winding spool of the winding device, wherein the winding device and the driving device are configured to operate simultaneously, such that the winding spool can be driven by the driving device to rotate, therefore, the first gear, the second gear, the driving wheel, the storing wheel, and the winding spool are restricted from rotating simultaneously when the first rotating unit is restricted from rotating in the first direction by the restriction force from the restriction spring.

In another embodiment of the present disclosure, the second rotating unit is the storing wheel of the driving device, and the second gear is positioned coaxially to the rotation axis of the storing wheel and configured to operate simultaneously with the storing wheel, wherein the second gear is engaged to the first gear by toothed engagement, and the third rotating unit is the winding spool of the winding device, wherein the winding device and the driving device are configured to operate simultaneously, such that the winding spool can be driven by the driving device to rotate, therefore, the first gear, the second gear, the driving wheel, the storing wheel, and the winding spool are restricted from rotating simultaneously when the first rotating unit is restricted from rotating in the first direction by the restriction force from the restriction spring.

In another embodiment of the present disclosure, the second rotating unit is the driving wheel of the driving device and configured to operate with the winding spool simultaneously, and the third rotating unit is the storing wheel, such that the second gear is positioned coaxially to the rotation axis of the storing wheel and configured to operate simultaneously with the storing wheel, wherein the second gear is engaged to the first gear by toothed engagement, and the winding spool can be driven by the driving device to rotate, therefore, the first gear, the second gear, the driving wheel, the storing wheel, and the winding spool are restricted from rotating simultaneously when the first rotating unit is restricted from rotating in the first direction by the restriction force from the restriction spring.

Figure 13:
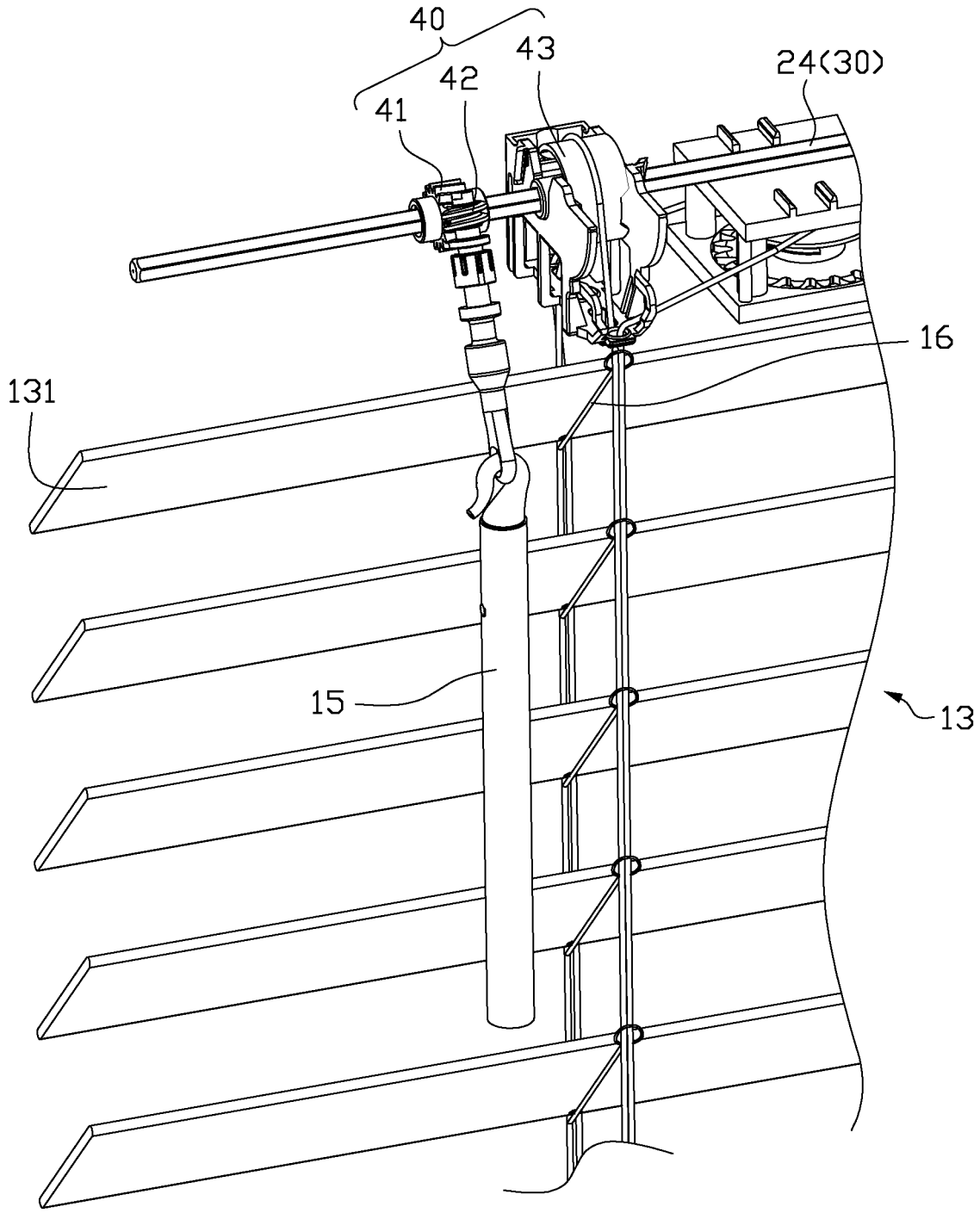
FIG. 13 is a partial perspective view of the window covering system in FIG. 4 and FIG. 8.

Referring to FIG. 4, FIG. 8 and FIG. 13, the rod 24 and the rod 30 are interchangeable with each other in any embodiment of the present disclosure. In FIG. 13, the aforementioned control unit, which was exemplified by the stick 15, can drive the rod 24 (or the rod 30) to rotate via a tilting device 40, wherein the tilting device 40 comprises a worm wheel 41 and a worm gear 42. The worm wheel 41 is sleeved to the rod 24 (or the rod 30) along the axial direction of the rod 24 (or the rod 30) and configured to rotate with the rod 24 (or the rod 30) simultaneously in the same direction; the worm gear 42 is connected to one end of the stick 15 and engaged to the worm wheel 41 by toothed engagement. When the worm gear 42 is driven to rotate by the stick 15, the worm wheel 41 engaged to the worm gear 42 by toothed engagement is driven to rotate by the worm gear 42, thereby driving the rod 24 (or the rod 30) rotating.

The window covering system 1 further comprising at least one ladder 16 which passes the plurality of slats 131 on one side of the slats 131, such that the multiple slats 131 are positioned one after another and spaced with each other along the axial direction of the ladder 16. The tilting device 40 further comprises at least one tilting wheel 43 which is sleeved to the rod 24 (or the rod 30) along the axial direction of the rod 24 (or the rod 30), wherein the tilting wheel 43 can be driven by the rod 24 (or the rod 30) to rotate with the rod 24 (or the rod 30) simultaneously in the same direction, and wherein one end of the ladder 16 is fixed to the tilting wheel 43. When the stick 15 is rotated, the rod 24 (or the rod 30) is driven to rotate by the stick 15 with the simultaneous operation between the worm gear 42 and the worm wheel 41, such that the tilting wheel 43 sleeved to the rod 24 (or the rod 30) is driven to rotate, thus, the ladder 16 fixed to the tilting wheel 43 is driven at the same time to drive the multiple slats 131 to tilt, thereby adjusting the angle of the multiple slats 131, as well as the light blockage of the multiple slats 131.

Previous descriptions are only embodiments of the present disclosure and are not intended to limit the scope of the present disclosure. Many variations and modifications according to the claims and specification of the disclosure are still within the scope of the claimed disclosure. In addition, each of the embodiments and claims does not have to achieve all the advantages or characteristics disclosed. Moreover, the abstract and the title only serve to facilitate searching patent documents and are not intended in any way to limit the scope of the claimed disclosure.

What is claimed is:

1. A window covering system, comprising:

a headrail, a bottom rail, a covering material, and a control unit, wherein the covering material is positioned between the headrail and the bottom rail, and the control unit is positioned outside of the headrail; and a first rotating unit positioned within the headrail, wherein the first rotating unit is configured to be driven to rotate in a first direction when the bottom rail descends to expand the covering material; and a locking device coiled to the first rotating unit, wherein the locking device comprises a fixed end and a free end, and the fixed end is fixed relative to the headrail, and wherein the locking device is configured to provide a restriction force to the first rotating unit in order to restrict the first rotating unit from rotating in the first direction, as well as to restrict the bottom rail from descending; and an actuating device comprising a pushing part, which is positioned corresponding to the fixed end and configured to operate with the control unit simultaneously, wherein the control unit is configured to drive the pushing part of the actuating device to push the free end of the locking device to move in order to remove the rotation restriction to the first rotating unit by reducing the restriction force provided by the locking device to the first rotating unit; when the rotation restriction to the first rotating unit is removed, the bottom rail descends by gravity to drive the first rotating unit to rotate in the first direction.

2. The window covering system according to claim 1, further comprising a second rotating unit positioned within the headrail, wherein the second rotating unit is configured to operate with the first rotating unit simultaneously; when the locking device restricts the first rotating unit from rotating in the first direction, the second rotating unit is restricted from rotating simultaneously; when the locking device removes the rotation restriction to the first rotating unit, the bottom rail descends to drive the second rotating unit to rotate, such that the second rotating unit drives the first rotating unit to rotate in the first direction.

3. The window covering system according to claim 2, the first rotating unit is coaxial to the second rotating unit, wherein the first rotating unit and the second rotating unit are configured to rotate simultaneously in the same direction.

4. The window covering system according to claim 2 or 3, further comprising a lifting cord connected to the second rotating unit at one end and to the bottom rail at the other end, wherein the lifting cord is configured to be collected by or released from the second rotating unit when the second rotating unit rotates, thereby ascending the bottom rail to collect the covering material or descending the bottom rail to expand the covering material; when the control unit drives the pushing part of the actuating device to push the free end of the locking device to move in order to remove the rotation restriction to the first rotating unit, the bottom rail descends to drive the second rotating unit to rotate via the lifting cord, thereby releasing the lifting cord, and driving the first rotating unit to rotate in the first direction.

5. The window covering system according to claim 2 or 3, further comprising a driving device comprising an elastic unit connected to the second rotating unit at one end; when the second rotating unit is driven to rotate by descending of the bottom rail, the elastic unit is wound upon the second rotating unit or released from the second rotating unit; when the control unit drives the pushing part of the actuating device to push the free end of the locking device to move in order to remove the rotation restriction to the first rotating unit, the bottom rail descends to drive the second rotating unit to rotate, thereby driving the first rotating unit to rotate in the first direction.

6. The window covering system according to claim 5, further comprising a winding device comprising at least one third rotating unit positioned within the headrail, wherein the at least one third rotating unit is configured to operate with the second rotating unit simultaneously; a lifting cord connected to the at least one third rotating unit at one end and to the bottom rail at the other end, wherein the lifting cord is configured to be collected by or released from the at least one third rotating unit when the at least one third rotating unit rotates, thereby ascending the bottom rail to collect the covering material or descending the bottom rail to expand the covering material; when the control unit drives the pushing part of the actuating device to push the free end of the locking device to move in order to remove the rotation restriction to the first rotating unit, the bottom rail descends to drive the at least one third rotating unit to rotate via the lifting cord, thereby driving the second rotating unit to rotate, which drives the first rotating unit to rotate in the first direction.

7. The window covering system according to claim 2, wherein the rotation axis of the first rotating unit is substantially perpendicular to the rotation axis of the second rotating unit.

8. The window covering system according to claim 7, further comprising a first gear positioned coaxially to the rotation axis of the first rotating unit, and a second gear positioned coaxially to the rotation axis of the second rotating unit, wherein the first gear and the second gear are engaged by toothed engagement.

9. The window covering system according to claim 8, further comprising a one-way clutch connected to the first gear and positioned corresponding to the first rotating unit; when the first gear is driven by the second gear to rotate in the first direction, the first rotating unit is engaged to the first gear via the one-way clutch, thereby the first rotating unit and the first gear rotate in the first direction simultaneously; when the first gear is driven by the second gear to rotate in a direction opposite to the first direction, the first rotating unit is disengaged from the first gear via the one-way clutch, and the one-way clutch rotates solely relative to the first rotating unit, thereby the one-way clutch and the first gear rotate in the direction opposite to the first direction, and the first rotating unit is not rotating relative to the headrail.

10. The window covering system according to claim 9, further comprising a lifting cord connected to the second rotating unit at one end and to the bottom rail at the other end, wherein the lifting cord is configured to be collected by or released from the second rotating unit when the second rotating unit rotates, thereby ascending the bottom rail to collect the covering material or descending the bottom rail to expand the covering material; when the control unit drives the pushing part of the actuating device to push the free end of the locking device to move in order to remove the rotation restriction to the first rotating unit, the bottom rail descends to drive the second rotating unit to rotate via the lifting cord, thereby releasing the lifting cord, and driving the first rotating unit to rotate in the first direction.

11. The window covering system according to claim 9, further comprising a driving device comprising an elastic unit connected to the second rotating unit at one end; when the second rotating unit is driven to rotate by descending of the bottom rail, the elastic unit is wound upon the second rotating unit or released from the second rotating unit; when the control unit drives the pushing part of the actuating device to push the free end of the locking device to move in order to remove the rotation restriction to the first rotating unit, the bottom rail descends to drive the second rotating unit to rotate, thereby driving the first rotating unit to rotate in the first direction.

12. The window covering system according to claim 11, further comprising a winding device comprising at least one third rotating unit positioned within the headrail, wherein the at least one third rotating unit is configured to operate with the second rotating unit simultaneously; a lifting cord connected to the at least one third rotating unit at one end and to the bottom rail at the other end, wherein the lifting cord is configured to be collected by or released from the at least one third rotating unit when the at least one third rotating unit rotates, thereby ascending the bottom rail to collect the covering material or descending the bottom rail to expand the covering material; when the control unit drives the pushing part of the actuating device to push the free end of the locking device to move in order to remove the rotation restriction to the first rotating unit, the bottom rail descends to drive the at least one third rotating unit to rotate via the lifting cord, thereby driving the second rotating unit to rotate, which drives the first rotating unit to rotate in the first direction.

13. The window covering system according to claim 1, further comprising a rod connected to the control unit and the actuating device; when the control unit drives the rod to drive the pushing part of the actuating device to push the free end of the locking device to move in order to remove the rotation restriction to the first rotating unit, the bottom rail descends by gravity to drive the first rotating unit to rotate in the first direction to expand the covering material.

14. The window covering system according to claim 13, wherein the rod is coaxial to the actuating device.

15. The window covering system according to claim 14, further comprising a tilting device connected between the control unit and the rod, wherein the tilting device comprises a worm gear and a worm wheel, wherein the worm wheel is connected to the rod for operating with the rod simultaneously, and the worm gear is connected to one end of the control unit for operating with the control unit simultaneously, and wherein the worm gear and the worm wheel are engaged by toothed engagement; when the worm gear is driven by the control unit to rotate, the worm wheel and the rod are configured to rotate.

16. The window covering system according to claim 15, further comprising at least one ladder, and the covering material comprises a plurality of slats which are horizontally arranged, wherein the plurality of slats are positioned one after another and spaced with each other along the axial direction of the at least one ladder; the tilting device further comprises at least one tilting wheel which is positioned to the rod and configured to operate with the rod simultaneously, and wherein one end of the at least one ladder is fixed to the at least one tilting wheel; when the rod is driven to rotate, the tilting wheel is driven to rotate by the rod, thereby the at least one ladder drives the plurality of slats to tilt in order to adjusting the angle of the plurality of slats, as well as the light blockage of the plurality of slats.

17. The window covering system according to claim 1, wherein the locking device is a restriction spring coiled to the first rotating unit and providing a restriction force to the first rotating unit in order to restrict the first rotating unit from rotating in the first direction and to restrict the bottom rail from descending; when the control unit drives the pushing part of the actuating device to push the free end of the locking device to move in order to remove the rotation restriction to the first rotating unit by increasing the diameter of the restriction spring, the bottom rail descends by gravity to drive the first rotating unit to rotate in the first direction.

* * * * *